US008573266B2

(12) United States Patent
Knapp et al.

(10) Patent No.: US 8,573,266 B2
(45) Date of Patent: Nov. 5, 2013

(54) COOLING DEVICE FOR STABILISING A CONTAINER STRUCTURE

(75) Inventors: Peter Knapp, Schmatzhausen (DE); Alexander Schau, Regensburg (DE)

(73) Assignee: Krones AG (DE)

( * ) Notice: Subject to any disclaimer, the term of this patent is extended or adjusted under 35 U.S.C. 154(b) by 469 days.

(21) Appl. No.: 12/963,344

(22) Filed: Dec. 8, 2010

(65) Prior Publication Data

US 2011/0146837 A1 Jun. 23, 2011

(30) Foreign Application Priority Data

Dec. 22, 2009 (DE) ..... 10 2009 060 655

(51) Int. Cl.
*B65B 3/04* (2006.01)

(52) U.S. Cl.
USPC ..... 141/82; 141/11; 141/168; 53/127; 53/440

(58) Field of Classification Search
USPC ..... 141/5, 11, 82, 129, 168; 53/127, 440
See application file for complete search history.

(56) References Cited

U.S. PATENT DOCUMENTS

| | | | | |
|---|---|---|---|---|
| 4,450,878 | A * | 5/1984 | Takada et al. | 141/48 |
| 5,251,424 | A * | 10/1993 | Zenger et al. | 53/431 |
| 5,555,702 | A * | 9/1996 | Sizer | 53/127 |
| 6,135,015 | A * | 10/2000 | Mendez | 99/453 |
| 6,378,571 | B1 * | 4/2002 | Schultz et al. | 141/70 |
| 6,505,656 | B2 * | 1/2003 | Schultz et al. | 141/70 |
| 6,763,858 | B2 * | 7/2004 | Schultz et al. | 141/70 |
| 6,834,473 | B2 * | 12/2004 | Wiedemann | 53/127 |
| 6,889,725 | B2 * | 5/2005 | Schultz et al. | 141/70 |
| 7,412,812 | B2 * | 8/2008 | Wild et al. | 53/440 |
| 7,735,304 | B2 * | 6/2010 | Kelley et al. | 53/558 |
| 8,273,293 | B2 * | 9/2012 | Dhruv et al. | 422/1 |
| 8,333,055 | B2 * | 12/2012 | Thomasset | 53/440 |
| 2007/0051073 | A1 * | 3/2007 | Kelley et al. | 53/440 |
| 2007/0180796 | A1 | 8/2007 | Wild et al. | 53/471 |
| 2007/0181211 | A1 * | 8/2007 | Klebe et al. | 141/231 |
| 2007/0235906 | A1 * | 10/2007 | Trouillet | 264/528 |

FOREIGN PATENT DOCUMENTS

| | | | |
|---|---|---|---|
| CN | 1903661 | 1/2007 | B65B 3/04 |
| DE | 20 2007 008 120 | 9/2007 | B29C 49/64 |
| EP | 1 975 116 | 1/2008 | B67C 3/14 |
| WO | WO 2006/079754 | 3/2006 | B67C 7/00 |

OTHER PUBLICATIONS

English translation only, of Office Action issued in corresponding Chinese Patent Application No. 2010105901985, dated Jul. 4, 2012, 14 pgs.

* cited by examiner

*Primary Examiner* — Gregory Huson
*Assistant Examiner* — Nicolas A Arnett
(74) *Attorney, Agent, or Firm* — Hayes Soloway P.C.

(57) ABSTRACT

An apparatus for filling containers, in particular bottles, has at least one transport device for transporting the containers, at least one filling device for filling the containers and a tempering device for tempering a bottom area of the container. The tempering device is located at least at times at least partially in or below the bottom area of the transported containers and the filling device is arranged at least at times at least partially in or above a mouth area of the transported containers. The tempering device is mounted on the apparatus in such a way that tempering during or after filling becomes possible.

19 Claims, 1 Drawing Sheet

COOLING DEVICE FOR STABILISING A CONTAINER STRUCTURE

BACKGROUND OF THE INVENTION

The present invention is directed to a device and a method for cooling containers. In the so-called hot-fill filling of liquids into PET bottles, PET blanks, hereinafter referred to as preforms, are initially blown into PET bottles in a blow moulding machine. Subsequently, the bottles are directed to a filling machine by means of a transfer device (or a conveyor device) as to be filled there with a (hot) filling material. Subsequently, nitrogen is dripped onto the as yet unclosed bottles and shortly afterwards the bottles are closed. This method is also referred to as the nitro-hot-fill process. The bottle bottom is cooled in the transfer area between a blow moulding machine and a filling machine by means of water jets operating in series. Subsequently, the hot closed bottle is transported to the bottle cooler preferably by means of at least one conveyor belt. In the heat exchanger, the hot bottle is cooled down to room temperature.

From WO 2006/079754 A2 a method is known, by means of which the bottom of a bottle is moulded in such a way that the stresses acting on the bottle, which result from heat and pressure occurring during the filling of a heated liquid into the bottle, will not lead to any undesired deformation of the bottle.

Starting from the point in time when the hot liquid is in the bottle, the bottom is exposed to severe thermal stress; upon closing, the stress on the bottom is further intensified by the pressure increase which is generated in turn by the dripping in of nitrogen. The process so far, therefore, required a very accurate adjustment of all of the variable parameters, since otherwise the bottom would undesirably deform or would bulge outwards. This would mean, for example, that the centre of the bottom would come into contact with the standing surface and therefore the bottle could no longer stand in a controlled manner.

From DE 20 2007 008 120 U1 a device is known, by means of which the containers generated by a blow moulding machine may be cooled down by the time they reach a filling machine.

SUMMARY OF THE INVENTION

It is therefore the object of the present invention to provide a device which enables the deformation of freshly filled containers to be avoided in spite of high thermal stresses and high pressure stresses.

According to the invention, the above-mentioned object is achieved by means of a device for filling containers, which containers are preferably bottles. This device comprises at least one transport device for transporting the containers, at least one filling device for filling the containers and at least one tempering device for tempering a bottom area of the respective container. The tempering device is here at least at times at least partially located in or under the bottom area of the respective transported container or containers and the filling device is at least at times at least partially located in or above a mouth area of the transported containers. According to the invention, the tempering device is mounted on the apparatus in such a way that tempering is possible during and/or after the filling of the containers.

This is advantageous since an active and/or passive tempering of the containers becomes possible as a function of the thermal stress and/or the pressure stress acting on the containers. As a result, the cooling operation may be adapted to the respective boundary conditions or states and may also be operated with default settings.

In a further preferred embodiment of the present invention, the tempering device is a cooling device for cooling the bottom area of the container. The bottom area is here not only to be understood as the area which is provided for standing the bottle on a plane surface, but it also comprises the areas between the individual contacting areas that may be brought into contact with the erection plane, which areas are arranged to be offset in the longitudinal direction of the container. The bottom area of the container preferably also comprises the bottom wall area which extends at least in sections on the outside of the container in the longitudinal direction thereof and which follows on from the standing surface.

This embodiment is advantageous because a specific cooling of defined areas, in particular of the bottom area, may be carried out by means of the cooling device, as a result of which the stability of the respectively treated container in the application area may be specifically enhanced. Particularly preferably, the injection point of the respective container may be specifically cooled by means of the cooling device.

In a further preferred embodiment of the present invention, a flowable medium, which is preferably a fluid and particularly preferably water or air, may be applied onto the container by means of the tempering device.

It is also conceivable that for cooling, the tempering device has a solid body that consists for example of a cooled or coolable metal, ice or the like. The cooling temperature is here less than 40° C., preferably less than 30° C. and particularly preferably between 20° C. and 30° C. or less.

This embodiment is advantageous because the fluid supplied may preferably be tempered and, depending on the container or the liquid supplied, a medium that has the respectively corresponding or suitable thermal conduction coefficient may be used for cooling.

In a further preferred embodiment of the present invention, a heated fluid, i.e. a liquid or a gas, may be introduced into the container by means of the filling device, said fluid being ideally warmer than 30° C., preferably warmer than 50° C. and particularly preferably warmer than 70° C. The fluid is particularly preferably a liquid foodstuff, but it is also conceivable that other flowable substances may be filled into the containers.

In a further preferred embodiment of the present invention, the cooling device is mounted at least in sections before and/or in the area of the filling device and/or after the filling device in such a way that it forms at least one cooling section, so that at least in sections a periodical or continuous cooling of the transported bottles may be carried out.

This is advantageous since the cooling section (spraying of water onto the bottle bottom), which is located in the transfer area between a blow moulding machine, in particular a stretch blow moulding machine, and at least one filling device, may be extended. An additional cooling section could thus start at the end of the above-mentioned cooling section and end in front of a further filling device, in particular a droppler. Thus, the entire distance over which the bottles are transported preferably in a suspended manner, may be used to allow the bottoms to be cooled. It is therefore possible to cool the bottom during the filling process, as a result of which a heating of the bottom may be avoided.

A droppler is to be understood to be a device that supplies at least nitrogen to the containers or introduces it into the containers. Particularly preferably the bottles may be closed by means of the droppler or after the droppler by means of a closing device. It is further conceivable that the cooling section also extends within the droppler and extends only in sections along the transport distance provided after the droppler.

In a further preferred embodiment of the present invention, the cooling device has rigid and/or dynamic air and/or water nozzles in the area of the filling device, so that water may be supplied to the outside wall of the container. In the case of rigid air and/or water nozzles, the nozzles may be mounted so as to correspond with the transfer section or the cooling section. Preferably, rigid air and/or water nozzles may already be provided in the area of the filling device and/or in the transfer section after the filling device.

The term rigid here means preferably stationary and particularly preferably immobile, but the term stationary may also include pivoting and/or rotating movements of the nozzles.

Dynamic air and/or water nozzles preferably travel together with the bottle or the filling valve. This means that the dynamic air and/or water nozzles are preferably mobile and the term mobile is to be understood to include pivotable, rotatable and/or moveable relative to the surroundings. A movement of the dynamic air and/or water nozzles may be carried out as a function of the transport speed and the transport route of the containers. Particularly preferably, the dynamic water nozzles are movable in such a way that they have, at least in sections, the same or approximately the same speed as the transported containers and thus the direction of movement and the speed of movement of the containers essentially corresponds to the direction of movement and the speed of movement of the air and/or water nozzles.

In the case of dynamic water nozzles, the feeding in of water may be carried out for example by way of rotary distributors, as a result of which a targeted and more effective cooling would be possible. In addition, also combined arrangements of dynamic and rigid air and/or water nozzles would be conceivable or dynamic air and/or water nozzles could be used at times as rigid nozzles or as nozzles having limited degrees of freedom of movement.

In a further preferred embodiment of the present invention, the apparatus has a further filling device, said further filling device being preferably arranged along the transport route of the containers after the first filling device that fills the containers preferably with hot or heated liquids. The further filling device is here preferably to be understood to be a droppler, which preferably delivers a fluid and particularly preferably a gas and particularly preferably nitrogen for introducing it to the container or introduces it into the container.

Along the transport route of the bottles upstream of the first filling device, a blow moulding machine for moulding preforms into containers or bottles is preferably provided. Preferably, the containers are made at least partially from a plastic material and are particularly preferably PET bottles.

In a further preferred embodiment of the present invention, a heat exchanger is provided along the transport route of the containers downstream of the further filling device, and the container may be cooled during the transfer from the further filling device to the heat exchanger at least periodically by means of at least one cooling device. The transfer is preferably carried out at least in sections by means of a conveyor belt. However, it is also conceivable that essentially the entire transfer from the further filling device to the heat exchanger is carried out by means of a conveyor belt. Immediately after closing, the bottles are transported to the heat exchanger on the conveyor belt. Here, too, an active or passive cooling of the bottom could already be carried out.

This embodiment is advantageous since, due to the nitrogen supplied in the further filling device upon closing the containers, a pressure increase occurs within the containers and thus, as a result of the bottom cooling that is taking place, a deformation of the container bottom is avoided.

In a further preferred embodiment of the present invention, the cooling device and at least one further cooling device are formed in the area between the further filling device and the heat exchanger partially in such a way that they include a water bath and/or water nozzles or air nozzles. On the one hand it is possible to transport the bottles in a water bath to the cooler, i.e. a conveyor belt chain on which the bottles stand runs through a water bath.

However, a water bath may also be provided in the area between the blow moulding machine and the droppler or the further filling device.

On the other hand, the water and/or air nozzles may be arranged for example on the inside of the transport belts in such a way that the respective fluid may be injected upwards through them, i.e. preferably in the direction of the containers. The chain links required for this purpose need to be correspondingly adapted, i.e. holes may be provided in the chain links, in order to be able to spray the water jet from the inside of the conveyor belt onto the bottle bottom. In the case of using air nozzles it is conceivable to feed in recycled air from the blow moulding machine.

The after-cooling facility for the bottom, as described above, does not need to be integrated in the complete conveyor belt route up to the bottle cooler. "Cooling sectors" are also conceivable through which cooling may be applied to the bottle bottoms. Thus, cooling sectors describe sections of the entire transfer route, which may be formed for example by means of water and/or air nozzles, water baths, similar components and combinations thereof.

Depending on the size of the device, the bottles need a predefined time in order to get to the heat exchanger. In a preferred embodiment of the present invention, the bottles need approx. 1.5 to 3.5 minutes and particularly preferably approx. 2.5 minutes in order to reach the heat exchanger. During this period of time, the bottle bottom, as described above, is exposed to a much enhanced process, i.e. in this phase, the bottle bottom needs to compensate for an internal bottle pressure of approx. 1-3 bars, preferably 1.3-2.0 bars in the case of a hot filling material. By means of the devices mentioned above, the bottom is no longer subjected to severe stresses during the filling phase and during transport, since a continuous or sectional and preferably essentially permanent cooling process is carried out. As a result, on the one hand the bottom weight of the container or of the bottle may be reduced and/or on the other hand the internal bottle pressure may be increased.

A preferred embodiment of the invention further comprises a sterilisation device for closures. The advantage in the case of a process in which containers are filled with hot liquids is, amongst others, that after a closing operation, the containers can be pivoted, so that the hot product does not only come into contact with the internal container wall, but also with the internal closure wall. The hot product thus contributes to a disinfection or sterilisation of the closure. To this end, a turning station is disposed along the treatment section between the filling machine and the outlet from the system, in which filling station the containers may be at least partially rotated or pivoted at least at times. Preferably, in this turning station, too, cooling of the container bottom is carried out. According to a preferred embodiment, the containers are rotated through an angle of between 75 degrees and 100 degrees, more preferably between 85 degrees and 95 degrees, so that they are transported approximately in a horizontal orientation. In this position, the cooling of the container bottom can then be carried out or continued. The application of the cooling medium may be carried out by means of nozzles.

In a further embodiment, the transport means which detects the containers in the turning station, is formed to be continuous, such as e.g. in a transport chain. In order to avoid excessive stress on the transport means in the course of the operation with regard to temperature, a cooling medium may be applied on the return. The same cooling medium is preferably also used for cooling the container bottoms. It is further conceivable that two media are taken from one and the same supply and are returned thereto.

The invention thus preferably relates to technical processes for a filling operation wherein nitrogen is supplied to the containers, and the invention particularly relates to a nitro-hot-fill filling process which is carried out using nitrogen.

The present invention is also directed to a process for filling containers, particularly bottles. The containers are transported by means of at least one transport device, they are filled with a filling device which is located at least at times at least partially in or above a mouth area of the transported containers, and is tempered by means of at least one tempering device which is mounted at least at times at least partially in or below a bottom area of the transported containers. According to the invention, the containers are at least periodically cooled during and/or after the filling by means of the tempering device.

At this point it is to be noted that all of the features disclosed in the application documents develop generic filling apparatus or filling apparatus known from the prior art in an advantageous manner either individually or in combination with each other.

BRIEF DESCRIPTION OF THE DRAWINGS

Further advantages, aims and characteristics of the present invention will be explained by means of the following description of the attached drawings, wherein filling apparatus for filling containers are illustrated by way of example. Components of the filling apparatus, which at least essentially correspond to each other in the figures with regard to their function, may here be identified with the same reference numerals, but such components may not be referenced or explained in all of the figures, wherein.

DETAILED DESCRIPTION OF THE INVENTION

Figure 1:
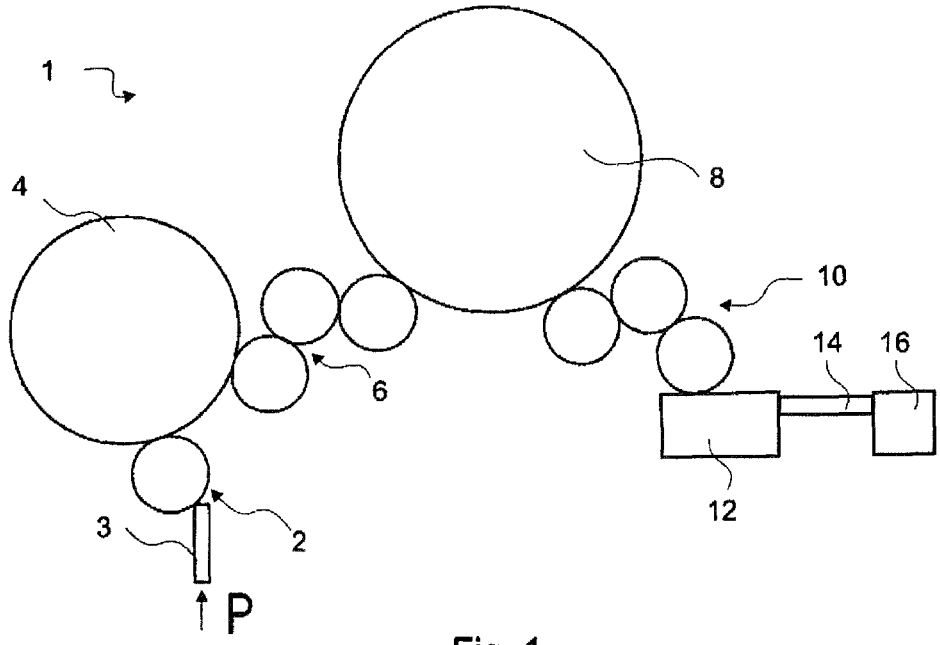
FIG. 1 shows a first schematic view of a filling device.

FIG. 1 shows a schematic view of an apparatus 1 for filling containers. Arrow P identifies a supply direction in which preforms from a device arranged upstream thereof are supplied via the transport route section 2 to a blow moulding machine 4 for moulding the preforms into bottles.

The bottles produced in the blow moulding machine 4 can be supplied along the transport route section 6 to a filling device 8 for filling the bottles with a preferably heated substance and particularly preferably with a heated liquid.

The containers filled in the filling device 8 can be supplied along the transport route section 10 to a further filling device 12 for further filling the containers with a gas. In the further filling device 12 or in the transport route of the containers downstream the further filling device 12, the bottles are closed by means of a closing device (not shown).

The closed bottles are subsequently transported to a heat exchanger 16 along the transport route section 14. In this heat exchanger 16, the containers and the liquid contained therein and/or the gas contained therein is/are cooled.

In the transport route sections 2, 6, 10, 14, the containers or preforms may be transported at least in sections either in a suspended and/or in a standing orientation. In sections, the transport route sections 2, 6, 10, 14 preferably consist of at least one rotational conveyor and/or at least one linear conveyor unit (3, 14). A linear conveyor unit 3, 14 can also convey the containers or preforms to be transported around bends. However, at least in sections the transport movement is carried out not about a single rotary axis. It is also conceivable that a transfer of the bottles from the blow moulding machine 4 to the filling device 8 and/or from the filling device 8 to the further filling device 12 is carried out directly, i.e. one or several transport route sections 6, 10 are not provided.

It is further conceivable that active and/or passive cooling of an area and in particular of the bottom area of the transported bottles is/are carried out in each of the available transport route sections 2, 6, 10, 14 or at least in sections in individual ones of the route sections 2, 6, 10, 14.

The blow moulding machine 4 and the filling device 8 as well as the further filling device 12 may also be regarded as transport devices in which, or in the area of which, also active and/or passive cooling either in combination with each other or individually is/are conceivable. For cooling the containers, cooling devices are provided at least in sections in preferably all of the transport devices.

However, it is also conceivable here that the cooling devices are provided only in individual transport route sections 2, 4, 6, 8, 12, 14, 16 or may be understood in sections as one single cooling device.

A cooling device may here be implemented as a bath cooling, i.e. it may be implemented at least in sections for cooling an area of the transported containers or the transported containers. A bath cooling preferably has a cooled or coolable substance which is preferably fluid and particularly preferably liquid. In one embodiment, the substance is preferably water, and this water may, depending on the requirements, be mixed with one or several additives. The bath cooling may be equipped with a cooling device for cooling the substance present in the bath and/or it may include circulation for exchanging the heated substance.

It is also conceivable that the bath cooling is complemented or replaced by cooling by means of water nozzles and/or air nozzles. The cooling device or cooling devices is/are particularly preferably controllable by means of a control device and/or a sensor device, and to this end parameters are selected from the group at least consisting of conveyor speed, filling speed, filling temperature, material of the preforms, size of the bottle, similar things and combinations thereof.

The filling of the liquid in the filling device 8 and/or of the gas in the further filling device 12 can be carried out in interlocked, periodically interlocked and non-interlocked machines. In the case of non-interlocked machines, the blow moulding machine 4 and the filling machine 8 are preferably installed separately from each other and are connected to each other for example by means of an air transporter (not shown). If an air transporter is used, the bottom cooling of the containers is preferably only carried out by means of the process air used by the air transporter. A bottom cooling between the blow moulding machine and the filling device may therefore preferably be dispensed with, if or since the duration of the transport of the bottles is sufficient for cooling the bottles. Thus, embodiments are conceivable which include cooling devices only during filling of the containers in the filling device and/or in downstream devices or in transport sections. However, a combined arrangement, i.e. an arrangement in which both an air transporter and a further device for cooling the container bottoms are provided between the blow moulding machine and the filling device, is also conceivable.

Further it is conceivable that at least in the area between the filling device and the heat exchanger, a head space steriliser for sterilising the closure means, which may be used to close the containers, and/or in particular for sterilising the head area or the mouth area of the containers (inside and/or outside) is provided.

Figure 2:
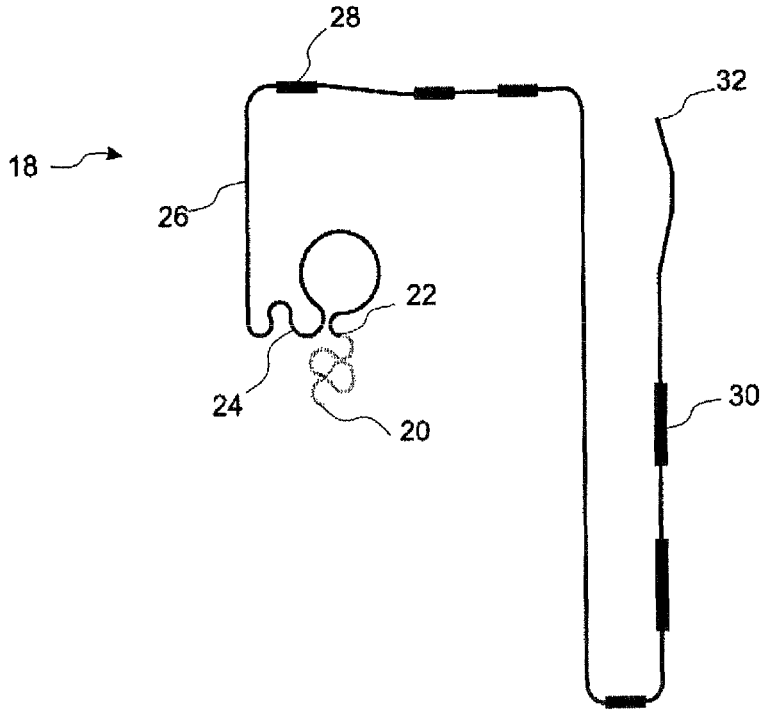
FIG. 2 shows an example of a cooling section as may be provided in an embodiment of the present invention.

FIG. 2 shows a schematic view of a conveyor route 18. The conveyor route includes a further conveyor section which extends between reference numerals 20 and 22. In this conveyor section, the preforms are moulded into containers by means of a blow moulding machine. In the transport section between reference numerals 20 and 22, post-cooling of the bottoms is preferably carried out. Between reference numerals 22 and 24, the conveyor route 18 preferably extends through a filling device in which the bottoms of the containers are cooled. In the conveyor route section extending between reference numeral 24 and reference numeral 32, the containers are preferably transported on a conveyor belt 26. The containers are guided by the conveyor belt 26 through section cooling areas 28, 30, where they are cooled at least in a bottom area. It may be seen from FIG. 2 that the section cooling areas 28, 30 may be formed to have different lengths and may be provided in any desired number and at any desired position along the transport route 18.

All of the features disclosed in the application documents are claimed as being essential to the invention in as far as they are novel over the prior art either individually or in combination.

LIST OF REFERENCE NUMERALS

1 Apparatus
2,6,10,14 Transport route section
3,14 Linear conveyor unit
4 Blow moulding machine
8 Filling device
12 Further filling device
16 Heat exchanger
18 Transport route
20,22,24,32 Transport sections
26 Conveyor belt
28,30 Section cooling areas
P Arrow

The invention claimed is:

1. An apparatus for filling containers, comprising at least one transport device for transporting the containers, at least one filling device for filling the containers and a tempering device for tempering a bottom area of the containers, wherein the tempering device is arranged at least at times at least partially in or below a bottom area of the containers as they are being transported, and the filling device is arranged at least at times at least partially in or above a mouth area of the containers as they are being transported, and wherein the tempering device is arranged on said apparatus such that tempering during or after a filling operation by said filling device becomes possible, and wherein the tempering device is mounted at least in sections before the filling device and a fluid supplied by the filling device is warmer than 30° C.

2. The apparatus as claimed in claim 1, wherein the tempering device is a cooling device for cooling the bottom area of the container.

3. The apparatus as claimed in claim 2, wherein a flowable medium comprising a fluid, water or air is applied to the container using the tempering device.

4. The apparatus as claimed in claim 1, wherein a heated fluid is introduced into the container using the filling device.

5. The apparatus as claimed in claim 1, wherein the at least one tempering device is mounted in an area of the filling device and/or after the filling device so as to form at least one cooling section, so that at least in sections a periodical or continuous cooling of the transported bottles may be carried out.

6. The apparatus as claimed in claim 1, wherein the tempering device has rigid and/or dynamic water nozzles in an area of the filling device, in order to supply water to the outside wall of the container.

7. The apparatus as claimed in claim 1, wherein the apparatus includes a further filling device arranged downstream of the filling device along a transport route of the containers.

8. The apparatus as claimed in claim 7, wherein a heat exchanger is provided downstream of the further filling device along the transport route of the containers.

9. The apparatus as claimed in claim 8, wherein the tempering device or at least one further cooling device is formed in an area between the further filling device and the heat exchanger partially as a water bath and/or as having water nozzles or air nozzles.

10. The apparatus as claimed in claim 1, wherein the tempering device is a device for tempering a bottom area of the containers.

11. The apparatus as claimed in claim 10, wherein an additional tempering device is mounted in an area after the filling device.

12. The apparatus as claimed in claim 10, wherein the tempering device has at least one tempering section, so that at least in sections a continuous cooling of the transported containers may be carried on.

13. The apparatus as claimed in claim 12, wherein said tempering section describes sections of an entire transfer route.

14. The apparatus as claimed in claim 10, wherein the container is a bottle.

15. The apparatus as claimed in claim 1, wherein an additional tempering device is mounted in an area after the filling device.

16. The apparatus as claimed in claim 1, wherein the tempering device has at least one tempering section, so that at least in sections a continuous cooling of the transported containers may be carried on.

17. The apparatus as claimed in claim 16, wherein said tempering section describes sections of an entire transfer route.

18. The apparatus as claimed in claim 1, wherein the container is a bottle.

19. A method for filling containers, wherein the containers are transported using at least one transport device, are filled by a filling device which is located at least at times at least partially in or above a mouth area of the transported containers and are tempered using a tempering device which is located at least at times at least partially in or below a bottom area of the transported containers, wherein the containers are cooled by the tempering device at least periodically during or after the filling operation, the tempering device being mounted at least in sections before the filling device, and a fluid supplied by the filling device is warmer than 30° C.

* * * * *